US005967395A

United States Patent [19]

Ito

[11] Patent Number: 5,967,395

[45] Date of Patent: Oct. 19, 1999

[54] TERMINAL BELT GUIDING MECHANISM TO BE USED WITH A TERMINAL CRIMPING UNIT

[75] Inventor: Akira Ito, Yokkaichi, Japan

[73] Assignee: Sumitomo Wiring Systems Ltd., Yokkaichi, Japan

[21] Appl. No.: 08/888,945

[22] Filed: Jul. 7, 1997

[30] Foreign Application Priority Data

Jul. 4, 1996 [JP] Japan ..... 8-174615

[51] Int. Cl.[6] ..... B65H 20/00

[52] U.S. Cl. ..... 226/193; 226/168

[58] Field of Search ..... 242/566, 535.5, 242/564.4, 615.4, 615.3, 615; 226/168, 190, 193, 21, 22, 23

[56] References Cited

U.S. PATENT DOCUMENTS

| | | |
|---|---|---|
| 2,012,130 | 8/1935 | Kellogg . |
| 2,261,359 | 11/1941 | Gautier . |
| 2,297,128 | 9/1942 | Benson . |
| 2,700,119 | 1/1955 | Krell . |
| 3,494,525 | 2/1970 | Wiig . |
| 3,698,614 | 10/1972 | Mohr et al. . |
| 3,931,671 | 1/1976 | Dittmann . |
| 3,965,559 | 6/1976 | Mazzola . |
| 4,629,178 | 12/1986 | Waddell et al. . |
| 4,654,952 | 4/1987 | Baldyga . |
| 4,724,954 | 2/1988 | Sillner . |
| 4,938,407 | 7/1990 | St. Hilaire . |
| 5,056,723 | 10/1991 | Inoue . |
| 5,142,765 | 9/1992 | Tanaka . |
| 5,170,921 | 12/1992 | Baldyga . |
| 5,564,613 | 10/1996 | Baldyga . |

FOREIGN PATENT DOCUMENTS

| | | |
|---|---|---|
| 0600416 | 6/1994 | European Pat. Off. . |
| 0711010 | 5/1996 | European Pat. Off. . |
| 2524726 | 10/1983 | France . |
| 2553683 | 4/1985 | France . |
| 4-46388 | 4/1992 | Japan . |
| 6251850 | 9/1994 | Japan . |
| 6275363 | 9/1994 | Japan . |
| 7-45352 | 2/1995 | Japan . |

OTHER PUBLICATIONS

Copy of a Search Report issued by the European Patent Office in Application No. EP 97304826, dated Mar. 25, 1998.

Copy of a Patent Abstracts of Japan vol. 95, No. 5, published Jun. 30, 1995 of JP No. 07–045352.

Copy of a European Search Report issued with EP Application No. 973005615.

Patent Abstracts of Japan vol. 18, No. 681. (E–1649).

*Primary Examiner*—Donald P. Walsh
*Assistant Examiner*—William A. Rivera
*Attorney, Agent, or Firm*—Greenblum & Bernstein P.L.C.

[57] ABSTRACT

To provide flexibility for a guided terminal belt, a rolling member is used to feed a terminal carrier. The rolling member has a contact area to make rolling contact with the carrier. The contact area presses the carrier against a guiding face as the carrier advances in a feeding direction. The feeding is performed when the terminal fitting of the terminal belt is in a released or disengaged state. This makes feeding possible regardless of the type of terminal fitting to be crimped, thus, providing flexibility for the terminal belt to be guided.

8 Claims, 7 Drawing Sheets

TERMINAL BELT GUIDING MECHANISM TO BE USED WITH A TERMINAL CRIMPING UNIT

BACKGROUND OF THE INVENTION

1. Field of the Invention

The present invention relates to an improved terminal belt guiding mechanism to be used with a terminal crimping unit, and, more specifically, relates to a terminal belt guiding mechanism which is to be incorporated into a terminal crimping unit.

2. Description of Background Information

It is generally known to have a series of terminal fittings extending perpendicular to a carrier belt. Such a terminal belt is normally fed in a predetermined supply direction by, for example, a guiding mechanism incorporated into a terminal crimping unit.

The conventional guiding mechanism includes a first guide plate that surrounds a contact face that supports the upper or lower surface of the carrier and a guiding face that positions the edge of the carrier. The contact face is perpendicular to the guiding face at all times. The conventional guiding mechanism further includes a guide member that guides the terminal area of the terminal belt by the first guide plate.

The conventional guiding mechanism was disadvantageous because the terminal belt is not flexible. The lack of flexibility is caused by the terminal belt being guided through a space primarily controlled by both a first and a second guide plate.

SUMMARY OF THE INVENTION

The present invention was designed to overcome the above-mentioned disadvantage. In the present invention, the solution to the problem is to provide a guiding mechanism for a terminal belt that is capable of providing flexibility in guiding the terminal belt. The terminal belt is intended to be used with a terminal crimping unit.

To solve the disadvantage of the known art, the present invention includes a guiding mechanism for a terminal belt. The guiding mechanism includes a contact face to support the carrier and a guiding face to continuously position the edge of the carrier belt. The edge is positioned on the belt on the opposite side of the terminal fittings and is perpendicular to the contact face. The terminal belt is a side-feed type and is guided along a predetermined feeding direction which is continuously supplied with terminal fittings that extend perpendicular to the carrier. The present invention further includes a rolling member with a contact area. The carrier is sandwiched between the contact area of the rolling member and the contact face of the guide mechanism.

The guide mechanism forms a nip by sandwiching the carrier between the contact face and the contact area of the rolling member. The nip allows the belt carrier to be fed when the terminal fittings on the terminal belt are disengaged. The terminal belt carrier is fed by being pressed against the guiding face in a direction along the contact face. The contact face can either contact the upper or the lower face of the carrier.

Another embodiment of the invention includes a guiding mechanism to be included in a terminal crimping unit. In this preferred embodiment, the contact area of the rolling member further includes formations that are capable of gripping the carrier.

In this embodiment, the formations allow the carrier to be gripped with greater force.

Another aspect of the present invention includes a screw groove as the formation on the contact area of the rolling member of the guiding mechanism.

If the embodiment of the invention includes the screw grooves on the contact area of the rolling member, the gripping force of the nip on the carrier is increased. Yet, the carrier can be easily detached from the nip.

Another embodiment of the invention includes a terminal crimping unit that includes a crimping part for crimping a cable terminal by severing the terminal fitting from the side-feed terminal belt. The terminal crimping unit further includes a guiding mechanism to guide the terminal belt and a terminal feeding area for feeding the terminal belt when the terminal fitting is in a disengaged or released state.

In this embodiment, the terminal fitting is fed to the crimping area when the builtin plate releases the terminal fitting.

In the present invention, a nip is formed between the contact area of the rolling member and the contact face. The nip guides the carrier, making it possible to feed the carrier when the terminal fitting is released. Thus, the versatility of the terminal belt is increased. The terminal belt is better guided due to an improved feeding method, without regard to the type of terminal fitting to be crimped.

Another embodiment of the present invention includes a terminal belt guiding mechanism including a contact face contacting a terminal carrier. The terminal carrier includes spaced and parallel terminal fittings. The terminal belt guiding mechanism further includes a guiding face that continuously positions the edge of the terminal carrier. The edge of the terminal carrier is on the opposite side of the terminal fittings on the terminal carrier. The terminal belt guiding mechanism further includes a rolling member that includes a contact area for contacting the terminal carrier such that the terminal carrier is sandwiched between the contact area and the contact face and a terminal supply area for feeding the terminal belt when the terminal fitting is disengaged from the terminal crimping area.

Another aspect of the present invention includes a terminal guide mechanism for a terminal belt wherein the contact area includes formations that are capable of gripping the carrier surface. In one embodiment, the formations include screw grooves.

Another preferred embodiment of the invention includes a terminal crimping unit that includes a side-feed terminal crimping area for crimping a terminal belt feed mechanism and a feeding mechanism for feeding the terminal carrier. The terminal carrier includes spaced and parallel terminal fittings. The terminal crimping unit further includes a terminal belt guiding mechanism that includes a contact face for contacting a terminal carrier, a guiding face for continuously positioning the edge of the terminal carrier, a rolling member including a contact area for contacting the terminal carrier such that the terminal carrier is sandwiched between the contact area and the contact face, and a terminal supply area for feeding the terminal belt when the terminal fitting is disengaged from the terminal crimping area. In this embodiment, the edge of the terminal carrier is on the opposite side of the terminal fittings on the terminal carrier.

Another aspect of the invention includes a terminal belt guide mechanism for a terminal belt that includes a contact that includes formations that are capable of gripping the carrier surface. In another aspect of the invention, the formations further include screw grooves.

BRIEF DESCRIPTION OF THE DRAWINGS

The invention will be better understood by referring to the description which follows with reference to the drawings, which illustrate by way of non-limiting examples, embodiments of the invention, with like reference numbers representing similar parts throughout the several views, and wherein.

DETAILED DESCRIPTION OF THE INVENTION

Figure 1:
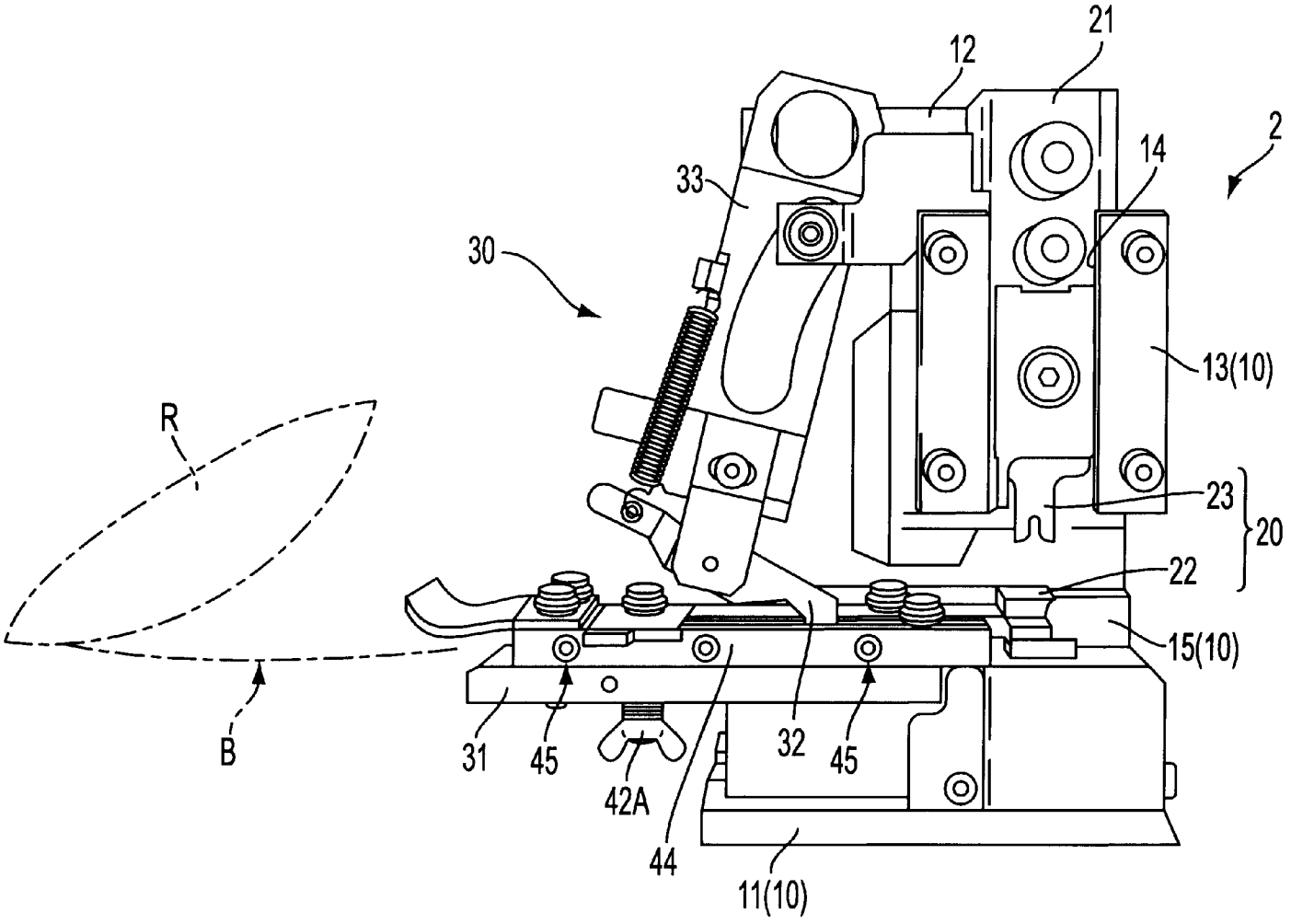
FIG. 1 is an overall view of a side-feed terminal crimping unit relating to one preferred embodiment of the present invention.
Figure 2:
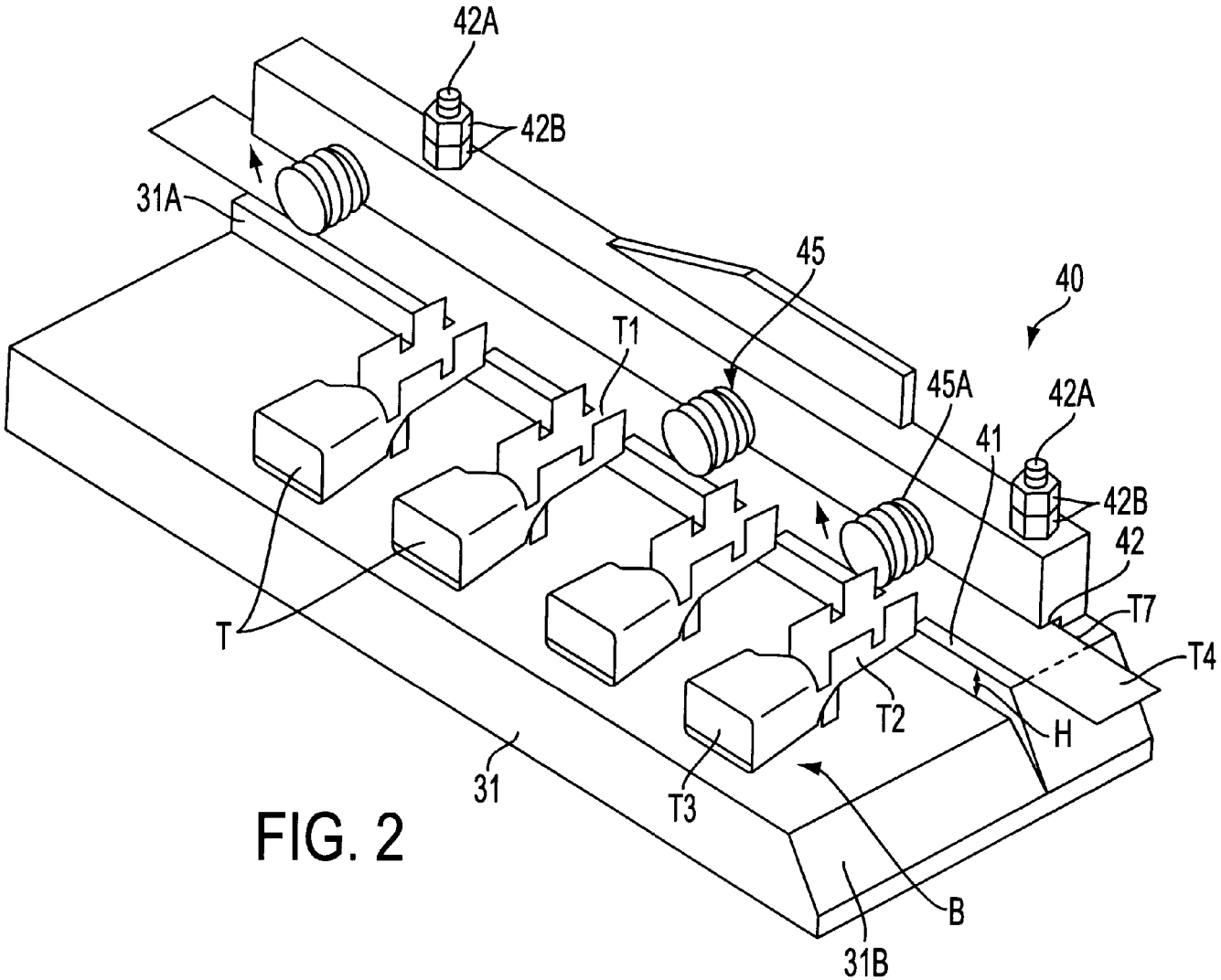
FIG. 2 is a perspective view of an important area of the terminal crimping unit shown in FIG. 1.
Figure 3:
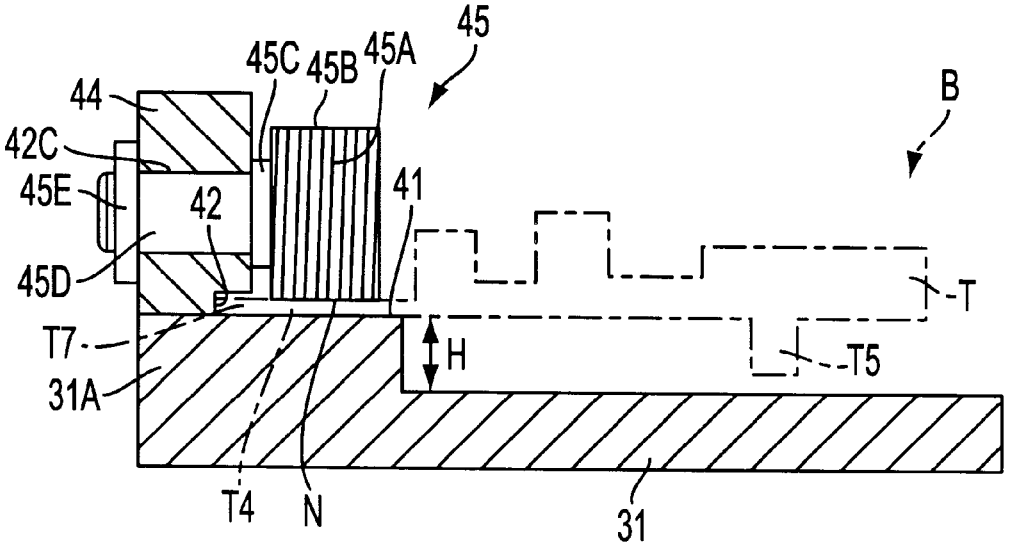
FIG. 3 is a cross-sectional view of an important area of the terminal crimping unit shown in FIG. 1.

The preferred embodiments of the invention are illustrated in detail as follows, referring to appended drawings. FIG. 1 is a diagram of a terminal crimping unit that uses a side feed method of one preferred embodiment of the invention. FIG. 2 is a perspective view of an important part of the embodiment of the invention shown in FIG. 1. FIG. 3 represents a cross-sectional view of an important aspect of the preferred embodiment shown in FIG. 1.

As shown in FIG. 2, in one preferred embodiment of the invention, the terminal belt B includes terminal fittings T positioned perpendicular to the longitudinal axis of the elongated carrier T4. The terminal fittings T are each connected to the elongated carrier T4 by a tie part T1. The tie part T1 extends at intervals along one side of the elongated carrier T4. The terminal fittings T of the terminal belt B further include a crimping part T2 that is crimped with the end of an insulated cable. The crimping action is not illustrated herein. The terminal fittings T further include a connecting part T3 that extends to the crimping part T2 to be connected with other terminal fittings. Additionally, the terminal belt B is wound on a reel body R as shown in FIG. 1.

As shown in FIG. 1, a preferred embodiment of the invention includes a terminal crimping unit 2 that includes a main body block 10. The main body block 10 includes, at predetermined positions, a terminal crimping area 20 for crimping the terminal fittings and a terminal belt feed area 30 for feeding the terminal fitting to the terminal crimping area 20. The terminal belt feed area 30 delivers the terminal belt B from the side of the terminal crimping area 20, thereby feeding the terminal fittings T.

The main body block 10 includes a main plate 11 and a side plate 12 that extends upward from the left side of the main plate 11. The guide block 13, which is substantially shaped like a backward "C" when viewed from above, is fastened to the side plate. The guide block 13 includes a guide groove 14 for guiding the shank 21 of the terminal crimping area, as will be described below. The guide groove 14 extends the length of the guide block 13, and contains a slit-like opening in the front of the guide block 13.

The main plate 11 is connected to a mounting plate 15 which faces the guide groove 14 of the guide block 13. The main plate 11 further allows the anvil 22 of the terminal crimping area 20 to be detachably mounted on the mounting plate 15. The terminal crimping area 20 further includes a shank 21 that is guided in the guide block 13 and an anvil that is mounted on the mounting plate 15. The terminal crimping area 20 further includes a pair of crimpers 23 that are mounted on the lower area of the shank 21 and are positioned to face the anvil 22.

The terminal feed area 30 includes a mounting plate 31 that is mounted on the main body block 10 and a feed claw 32 for feeding the terminal fittings T on the terminal belt B one at a time. The feed claw 32 accomplishes the feeding by a motion of the link lever 33, which connects the feed claw 32 to the terminal crimping area 20. The terminal belt guide mechanism 40, is also located on the mounting plate 31. In this preferred embodiment of the invention, where the terminal fittings are fed while the terminal crimping area 20 is disengaged and the terminal fittings are released, the structural elements other than those contained in the terminal feed area 30 and the terminal belt guide mechanism 40, are typically known. Thus, the details of the known elements will not be described in great detail herein.

Referring to FIG. 2 and FIG. 3, it is generally known that the terminal belt guiding mechanism 40 includes a contact face 41 that is formed on the mounting plate 31 and a rear member 44 which includes a guiding face 42. The guiding face 42 can be seen when viewing the terminal belt guide mechanism in cross-section. The guiding face 42 is positioned perpendicular to the contact face 41. As shown in FIG. 2, in one embodiment of the invention, there are three sets of feed rollers 45 mounted on the rear member 44.

The mounting plate 31 is substantially rectangular shaped and includes a step part 31A that is located on one of the long ends of the mounting plate 31. As shown in FIG. 3, the step part 31A is slightly higher than the mounting plate 31 and the contact face 41 is located on the upper surface of this step part 31A. The height H of the step part 31A is such that it does not interfere with the stabilizer part T5 of the plural types of the terminal fittings T that can be crimped by the terminal crimping area 20. Thus, plural types of terminal fittings can be fed. Additionally, the mounting plate 31 includes a chamfer or bevel 31B located at the end of the mounting plate 31 in the feeding direction of the terminal belt B.

The rear member 44 is preferably constructed of metal and is substantially square-shaped. The rear member 44 is located along the long section of the mounting plate 31 and is fastened to the step part 31A by a bolt 42A and a nut 42B. In this arrangement, the rear member 44 forms the guiding face 42. The guiding face 42 continuously positions the terminal fittings T of the elongated carrier T4 such that the edge part T7, which is on the opposite side of the terminal fittings T on the elongated carrier T4, abuts the guiding face 42.

In one preferred embodiment, the feed roller 45 includes a contact area 45B. Preferably, the surface of the contact area 45B includes screw grooves 45A. The feed roller 45 further includes a main axle part 45C that is coaxial and contiguous with the roller area 45B. The feed roller 45 further includes a small diameter part 45D which coaxially extends from the main axle area 45C. In this preferred embodiment, the small diameter part 45D is inserted into an insertion hole 42C of the rear member 44. The feed rollers 45 can be mounted on the rear member 44 so that they can freely rotate by fitting a stop ring 45E to a peripheral groove (not shown) formed on the small diameter area 45D. The feed roller 45 forms a nip N which sandwiches the elongated carrier T4 between the contact faces 41.

In one preferred embodiment, the screw groove 45A is formed on the outer surface of the contact area 45B. The screw groove 45A makes rolling contact with the elongated carrier T4. The screw groove 45A grips the elongated carrier T4, thereby causing the elongated carrier T4 to move in the feeding direction.

By adapting the contact area 45B to include the screw groove 45A, the screw groove 45A, in a sense, is the contact area that grips the elongated carrier T4. The screw groove 45A presses the elongated carrier T4 with greater force. Additionally, using the screw groove 45A can strengthen the holding power by the elongated carrier T4 being gripped by the nip N harder when feeding. Detaching the elongated carrier T4 from the nip N is possible by loosening the bolt 42A which holds the rear member 44.

Any marks made to the surface of the elongated carrier T4 by the screw groove 45A is of no consequence because the elongated carrier T4 is scrap material.

In this preferred embodiment, the screw groove 45A of the feed roller 45 acts as the rolling member. The screw groove 45A and the contact face 41 sandwich the elongated carrier T4, forming a nip N and guiding the elongated carrier T4, allowing the terminal fittings T of the terminal belt B to feed when in a released condition.

In this preferred embodiment, the terminal belt B can be fed without regard for the type of terminal fittings T to be crimped. This provides remarkable versatility for the terminal belt guiding mechanism 40.

The embodiments shown and described above are for illustrative purposes only and are not intended to limit the scope of the invention as defined by the claims. While the preferred embodiments of the invention have been illustrated and described, the present invention is not limited by the preferred embodiments as described and illustrated above. Various changes can be made therein without departing from the spirit and scope of the invention.

Figure 4:
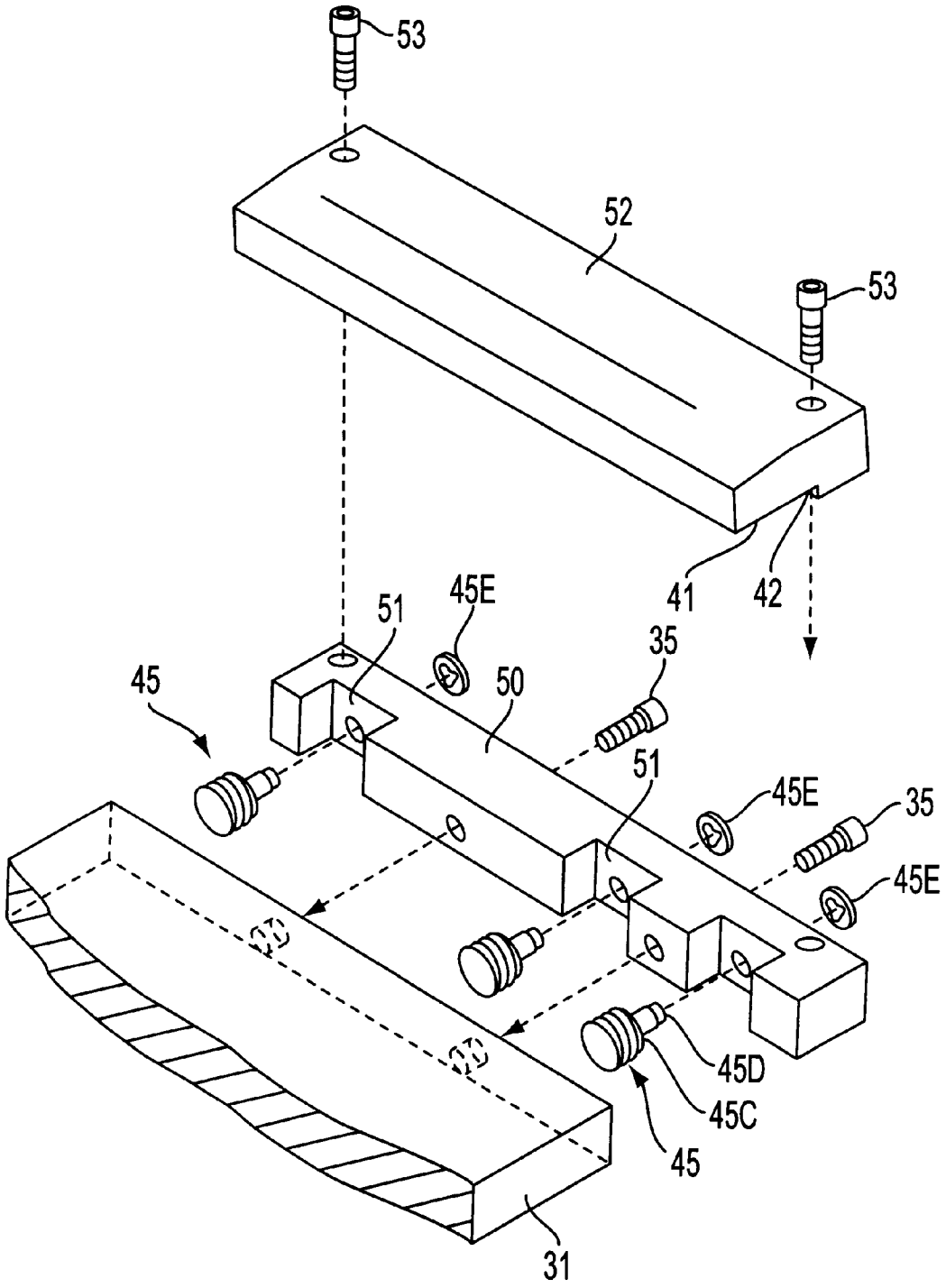
FIG. 4 is an exploded view of the terminal belt feed mechanism of another embodiment of a terminal crimping unit.
Figure 5:
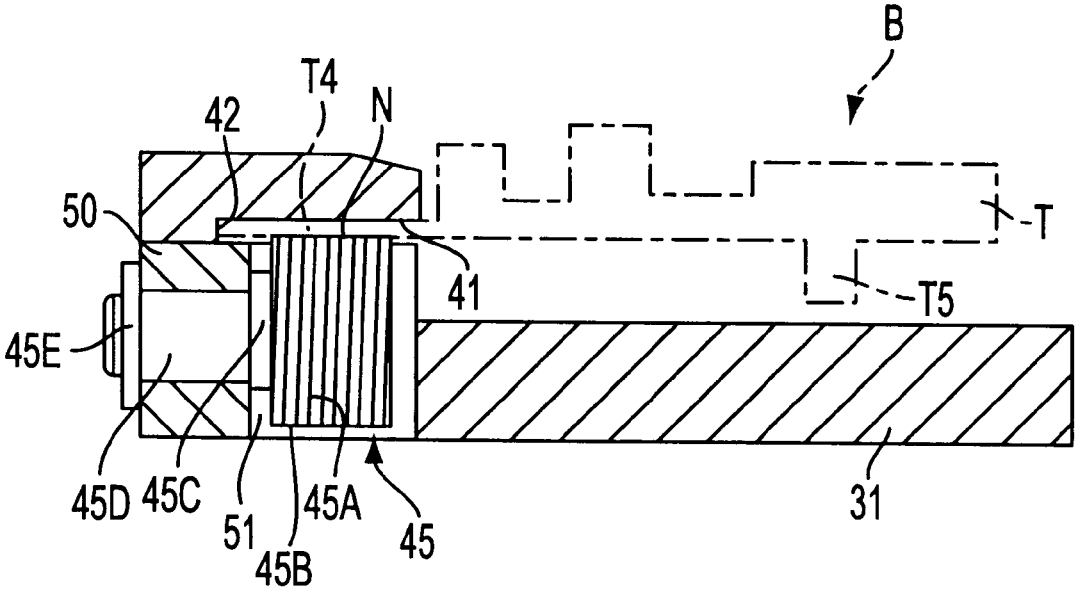
FIG. 5 is a cross-sectional view of an important area of the embodiment shown in FIG. 4.

For example, as shown in FIG. 4 and FIG. 5, other preferred embodiments may be adapted. FIG. 4 shows an exploded perspective view of a different embodiment and FIG. 5 is the cross-sectional view of part of the embodiment disclosed in FIG. 4. As shown in FIG. 4 and FIG. 5, the end face of the mounting plate 31 may be mounted with a bolt 35 onto the mounting member 50. The mounting member 50 includes housing recesses 51 for the feed rollers 45. The feed rollers 45 are mounted in the housing recesses 51 of the mounting member 50 in a manner similar to that discussed above. The cover member 52 is also mounted on the upper surface of the mounting member 50 by a bolt 53. The cover member 52 includes a contact face 41 and the guiding face 42. This structure makes it possible to support the upper surface of the elongated carrier T4 with the contact face 41 while feeding the lower surface of the elongated carrier T4 with a feed roller 45.

Figure 6:
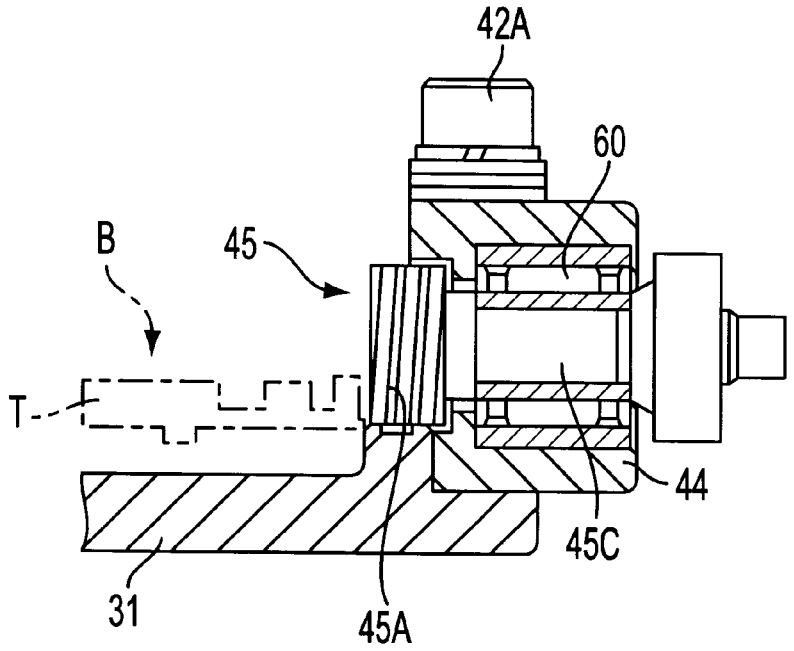
FIG. 6 is a cross-sectional view of an important part of the guiding mechanism of another embodiment of the present invention.

FIG. 6 is a cross-sectional view of part of another embodiment. As shown in FIG. 6, a small diameter 45C of the feed rollers 45 may be supported by a bearing 60. Further, the screw groove 45A of the feed rollers 45 is only one example of a formation placed on feed roller 45. The screw groove 45A can be replaced by other formations. Moreover, when a sufficient frictional or gripping force is obtained between the contact area 45B, i.e., the outer surface, of the feed roller 45 and the elongated carrier T4, a formation may not be necessary.

Figure 7:
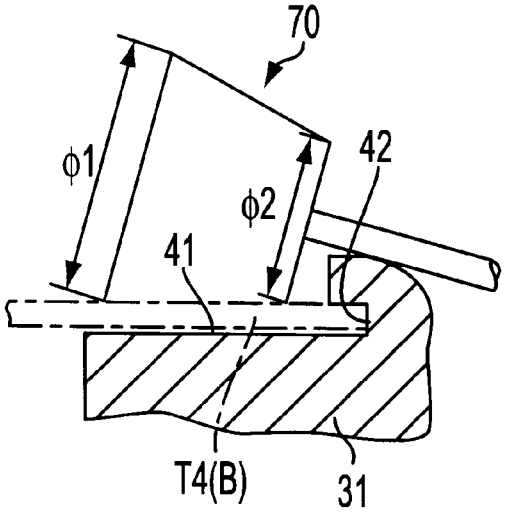
FIG. 7 is a cross-sectional view of an important part of the guiding mechanism of another embodiment to the present invention.

FIG. 7 is a cross-sectional view showing part of another embodiment of the present invention. As shown in the drawing, using a feed roller 70 that has a diameter Φ1 on the free side that is larger than the diameter Φ2 on the connected side, eliminates the necessity for a screw groove.

Figure 8:
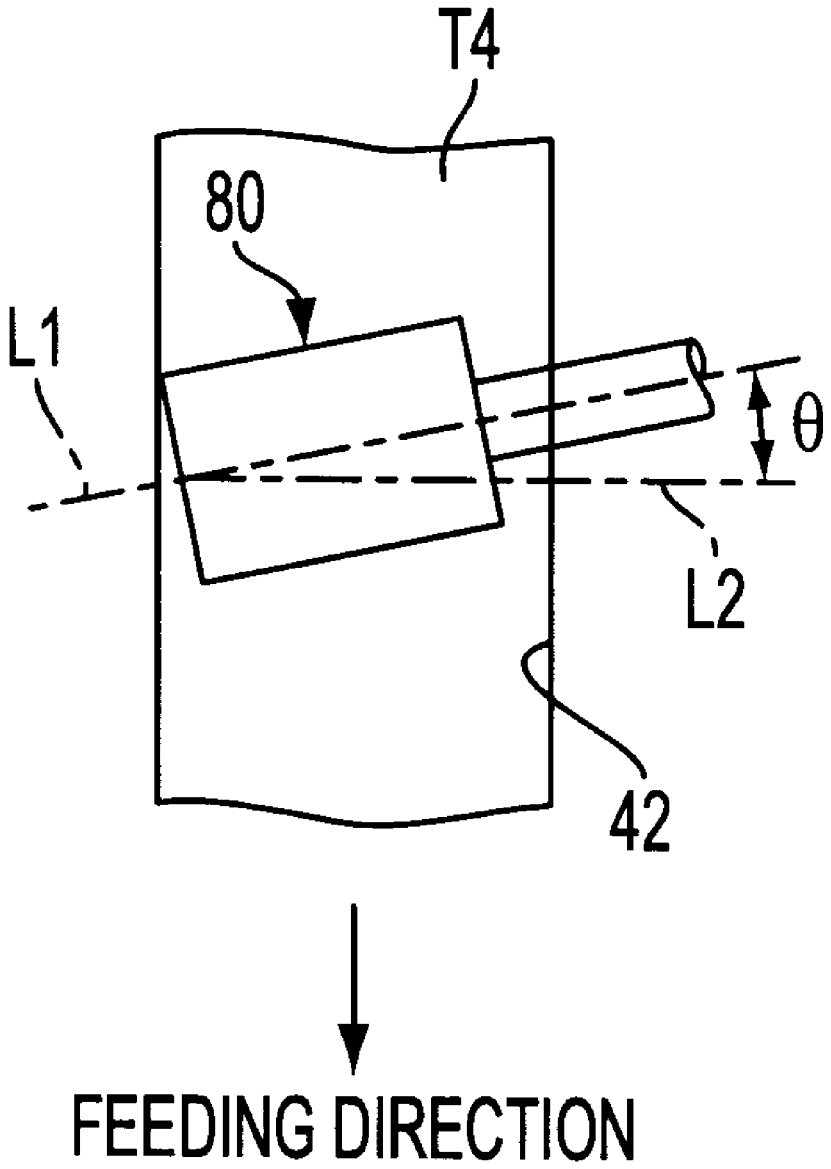
FIG. 8 is the cross-sectional view of an important part of the guiding mechanism of another embodiment of the present invention.

FIG. 8 is a schematic diagram of another embodiment of the present invention. As shown in FIG. 8, the virtual line L2 is perpendicular to the feeding direction. By tilting the axial line LI of the feed roller 80 at a predetermined angle θ from the virtual line L2, it is possible to feed the elongated carrier T4 while shifting the elongated carrier T4 toward the guiding face 42.

The present disclosure relates to subject matter contained in Japanese Application Nos. 8-174615 filed on Jul. 4, 1996 and 8-202444 filed on Jul. 31, 1996, which are expressly incorporated herein by reference in their entireties.

What is claimed is:

1. A terminal belt guiding mechanism comprising:

a contact face for contacting a terminal carrier, the terminal carrier including spaced and parallel terminal fittings;

a guiding face continuously positioning an edge of the terminal carrier, the edge of the terminal carrier being on the opposite side of the terminal fittings on the terminal carrier;

a rolling member including a contact area for contacting a surface of the terminal carrier such that the terminal carrier is sandwiched between said contact area and said contact face; and wherein said contact area comprises screw grooves capable of gripping the carrier surface, thereby increasing the gripping force exerted on the terminal carrier by the rolling member.

2. A terminal guide mechanism for a terminal belt according to claim 1, wherein said rolling member includes a first diameter on a free side of said rolling member and a second diameter on a connected side of said rolling member, wherein said first diameter is larger than said second diameter.

3. A terminal guide mechanism for a terminal belt according to claim 1, wherein an axis of said rolling member is tilted at a predetermined angle with respect to a line perpendicular to a longitudinal axis of said terminal carrier.

4. The terminal belt guiding mechanism according to claim 1, said rolling member comprising a feed roller rotatable about an axis, said axis being tilted at a predetermined angle such that an entire area of a peripheral surface of said feed roller contacts the terminal carrier as said feed roller rotates.

5. A terminal guide mechanism for a terminal belt according to claim 1, further comprising a terminal supply area for feeding the terminal belt when the terminal fitting is disengaged from the terminal crimping area.

6. A terminal crimping unit comprising:

a side-feed terminal crimping area for crimping a terminal belt feed mechanism;

a feeding mechanism for feeding a terminal carrier, the terminal carrier including spaced and parallel terminal fittings;

a terminal belt guiding mechanism including a contact face for contacting a terminal carrier, a guiding face for continuously positioning an edge of the terminal carrier, the edge of said terminal carrier being on the opposite side of the terminal fittings on the terminal carrier, a rolling member including a contact area for contacting a surface of the terminal carrier such that the terminal carrier is sandwiched between said contact area and said contact face, wherein said contact area comprises screw grooves capable of gripping the carrier surface, thereby increasing the gripping force exerted on the terminal carrier by the rolling member, and a terminal supply area for feeding said terminal belt when the terminal fitting is disengaged from said terminal crimping area.

7. A terminal guide mechanism for a terminal belt according to claim 6, wherein said terminal guide mechanism further includes said rolling members mounted within at least one housing recess, said contact face and said guiding face being on a cover member, wherein said terminal carrier contacts said contact face and said guiding face and a lower surface of said terminal carrier contacts said contact area of said rolling member.

8. The terminal crimping unit according to claim 6, said rolling member comprising a feed roller mounted for rotation about a rotation axis, said rotation axis being tilted at a predetermined angle such that an entire area of a peripheral surface of said feed roller contacts the terminal carrier as said feed roller rotates.

* * * * *

UNITED STATES PATENT AND TRADEMARK OFFICE

CERTIFICATE OF CORRECTION

PATENT NO. : 5,967,395

DATED : October 19, 1999

INVENTOR(S) : A. ITO

It is certified that error appears in the above-identified patent and that said Letters Patent is hereby corrected as shown below:

On the title page, item [73], Assignee, after "Systems" insert --- , ---.

item [56], References Cited, OTHER PUBLICATIONS, line 7, "No. 973005615" should be ---No. 97305615---.

Signed and Sealed this

Nineteenth Day of December, 2000

*Attest:*

Q. TODD DICKINSON

*Attesting Officer*

*Commissioner of Patents and Trademarks*